United States Patent [19]

Kranz

[11] 4,221,216

[45] Sep. 9, 1980

[54] EMERGENCY ESCAPE BREATHING APPARATUS

[75] Inventor: Max L. Kranz, Brea, Calif.

[73] Assignee: Robertshaw Controls Company, Richmond, Va.

[21] Appl. No.: 883,362

[22] Filed: Mar. 6, 1978

[51] Int. Cl.[3] ..... A62B 7/02; A62B 17/04

[52] U.S. Cl. ..... 128/201.23; 128/201.28; 128/205.22; 128/205.24

[58] Field of Search ..... 128/142 R, 142 G, 142.2, 128/142.3, 142.5, 142.7, 145 R, 145.8, 147, 203, 201.23, 201.28, 205.22, 205.24; 2/205, 202, 7, 2; 137/505.41, 458, 464

[56] References Cited

U.S. PATENT DOCUMENTS

| | | | |
|---|---|---|---|
| 2,262,522 | 11/1941 | Yant et al. | 128/201.23 X |
| 2,296,338 | 9/1942 | Dakin | 128/201.23 X |
| 3,043,302 | 7/1962 | Spears et al. | 128/203 |
| 3,250,292 | 5/1966 | Mollick | 137/505.41 X |
| 3,562,813 | 2/1971 | Origer | 128/142.7 X |
| 3,618,689 | 11/1971 | German | 137/464 X |
| 3,762,407 | 10/1973 | Shonerd | 128/142.3 |
| 3,911,914 | 10/1975 | Johansson | 128/142.7 |

*Primary Examiner*—Henry J. Recla
*Attorney, Agent, or Firm*—Fulwider, Patton, Rieber, Lee & Utecht

[57] ABSTRACT

There is disclosed an emergency escape breathing apparatus comprising a hood to be placed over a person's head and a pressured bottle supply of air or oxygen enriched air. The hood is formed of thin film, clear plastics in a tent structure having a bottom wall formed of a thin film elastomer. The elastomer film has an aperture of sufficient diameter to permit the hood to be pulled over the wearer's head and yieldably seals about the wearer's neck, functioning as an exhalation valve, maintaining adequate pressure to keep the hood inflated. The device is provided with a valve on the air supply bottle which has a reseatable valve member and two stages of flow control; the first stage being pressure control, providing a variable flow area which increases with declining pressure in the air supply bottle, and the second stage being flow control having a fixed diameter orifice. The reseatable valve member and flow control elements are all combined in a single unitary valve structure.

19 Claims, 6 Drawing Figures

FIGURE 1
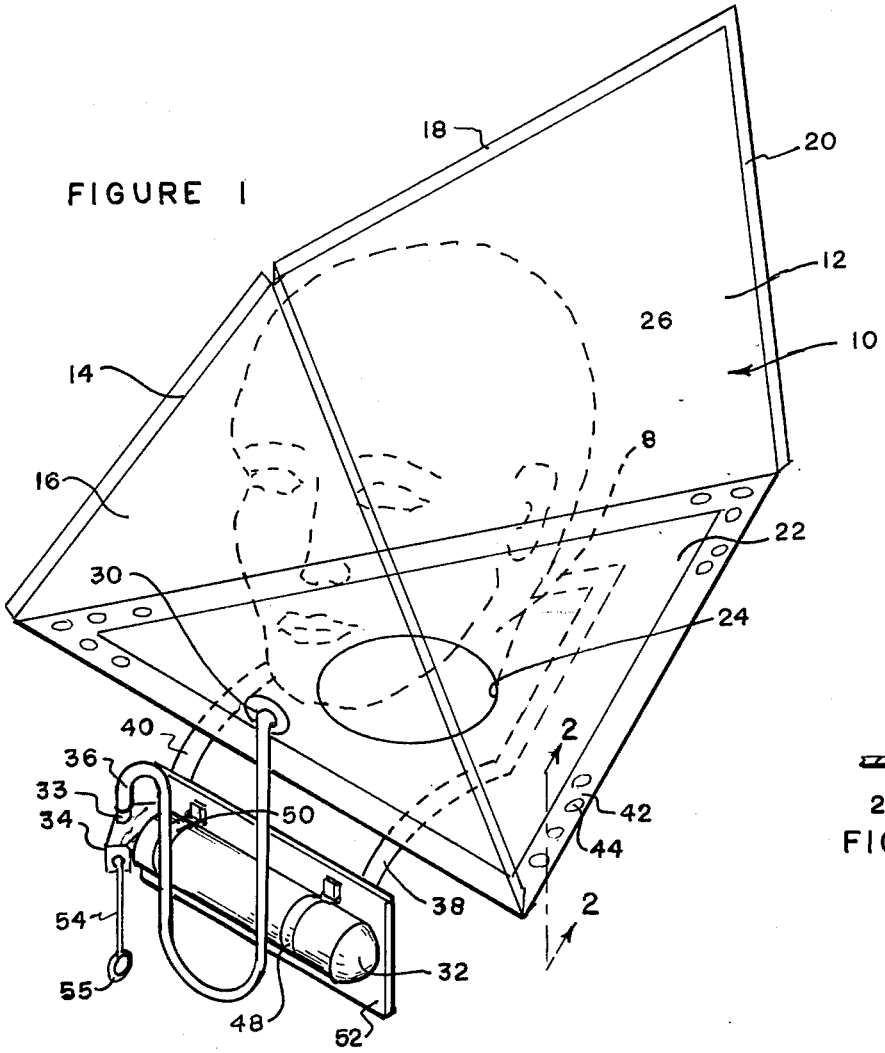
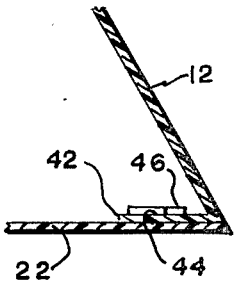
FIGURE 2
FIGURE 3
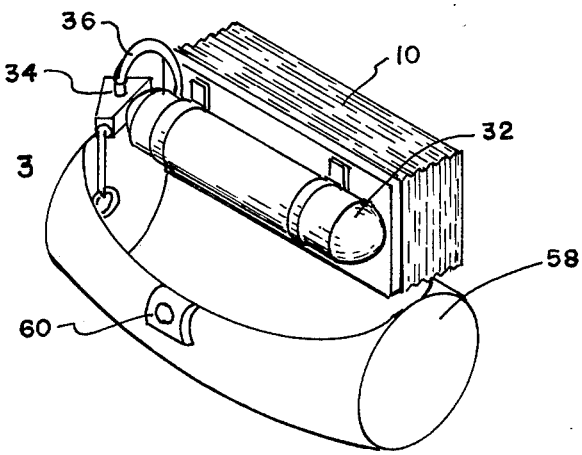

EMERGENCY ESCAPE BREATHING APPARATUS

BACKGROUND OF THE INVENTION

1. Field of the Invention

This invention relates to an emergency breathing apparatus particularly suited for providing a short term air supply to a wearer in a hostile environment such as a smoke-filled or burning building.

2. Brief Statement of the Prior Art

Emergency escape hoods which have been designed for use by industry and municipal fire fighters comprise a transparent hood that is pulled over the wearer's head and a pressured supply of air or oxygen which is released to the hood through a sealing diaphragm which is ruptured by a lever actuated by the wearer. The devices which have been developed to date are relatively bulky, being formed of thick film plastics with an elastic band to seal the hood about the wearer's neck and have required a separate exhalation valve. Additionally, the device have employed valves with rupture diaphragms rather than reseatable valves and thereby are more costly to recycle for reuse.

BRIEF DESCRIPTION OF THE INVENTION

This invention comprises an emergency escape breathing device which has a head hood formed of thin film plastics with a thin film elastomer base having a central aperture that permits placement of the hood over the wearer's head and that sealingly engages the wearer's neck. The elastomer film yieldably engages the wearer's neck to permit it to function similar to a flapper valve, eliminating the necessity for use of a separate exhalation valve.

The emergency escape breathing device also employs an air supply valve having a reseating valve member and two flow control stages. The first flow control stage comprises a ball resiliently seated against a hard metal seat and lifted therefrom by a pin which seats against the face of the reseating valve member. The latter is biased closed by a spring which biases the pin to constantly vary the flow area between the ball and hard metal seat in response to the air supply pressure. The second control stage controls the rate of flow and comprises a fixed diameter orifice passageway discharging into the tubing which communicates with the hood of the device.

BRIEF DESCRIPTION OF THE DRAWINGS

The invention will be described with reference to the FIGURES of which:

FIG. 1 illustrates the hood of the invention as deployed over a person's head and in the inflated condition;

FIG. 2 is a view along lines 2—2;

FIG. 3 is a view of the hood in its folded, compact position for storage;

DESCRIPTION OF PREFERRED EMBODIMENTS

Figure 4:
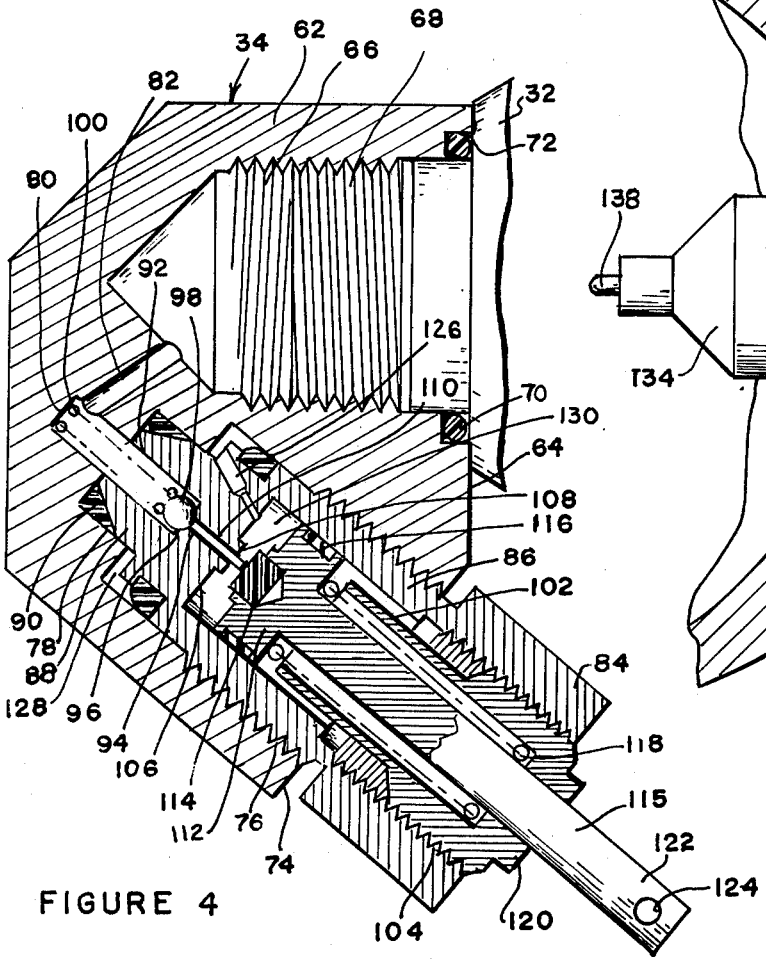
FIG. 4 is a sectional view of the gas control valve employed in the invention.

The invention is illustrated in FIG. 1 as comprising a hood 10 in the form of a sealed tent with vertical walls

12, 14 and 16 which are joined at their edges in seals such as 18 and 20 and which are secured, along with bottom edges to a thin elastomer film 22. The latter has a central opening 24 of sufficient diameter to receive the wearer's head 26 in a stretched state and to yieldably seal, when released, about the person's neck 28. The hood 10 has a single aperture 30 which connects to a breathable-atmosphere source, bottle 32, which contains a pressured supply of a breathable gas, typically an elemental oxygen containing gas such as oxygen, air or oxygen-enriched air.

The cylinder 32 is connected through a gas control valve 34 to a flexible tubing 36 which communicates with aperture 30. The bottle 32 is carried by straps 38 and 40 which extend to the elastomer film 22 and which are secured thereto. These straps extend about the central aperture 24 so the straps provide support for container 32.

The hood is formed of suitable thin film plastics. The tent of upright walls 12, 14 and 16 is formed of thin plastics of thicknesses less than about 3 mils which are preferably Kapton, a polyimide plastic having high tensile strength and a high useful temperature; the material resists charring at temperatures up to about 1472° F. Another useful plastic for this purpose is Mylar, a trade designation of DuPont deNemours for a polyester film of high tensile strength.

The bottom wall 22 is of a suitable elastomer, preferably synthetic or natural rubber latex which has a high resistance and sufficient elasticity to permit stretching to fit over the wearer's head. The elastomer film also serves as an exhalation valve since it yieldably seals about the wearer's neck after the hood is in place. The elastomer film thus maintains an appropriate internal pressure to keep the hood in its inflated and expanded position shown in FIG. 1 while permitting comfortable breathing for the wearer.

The elastomer film 22 is sealed to the bottom edges of the upright walls 12, 14 and 16. To this end, the bottom edges of the upright walls are folded inwardly at 42 and, preferably, bear a plurality of perforations 44. During assembly, the elastomer film is heat sealed to the bottom edges 42. This preferred seal is illustrated in FIG. 2 where the elastomer film 22 extrudes to form plugs 46 which extend through the apertures 44.

The bottle 32 is carried in the assembly by a pair of strap retainers 48 and 50 which are secured to a plate 52 that is attached to the ends of straps 38 and 40. The gas supply value 34 has a flow control valve member which is secured to lanyard 54 having a pull ring 56 for actuation by the wearer.

The entire assembly is very compact and can be folded and stored readily. FIG. 3 illustrates the assembly in its folded condition with the hood 10 collapsed and folded, accordion fashion, against plate 52, thereby permitting the entire assembly to be placed within a small valise or container 58 having a snap fastener 60 or the like.

Referring now to FIG. 4, the gas supply valve 34 will be described. As illustrated, the valve 34 comprises a valve housing 62 formed of a metal block having the valve passageways machined therein. The block 62 has a face 64 which bears an internally threaded aperture 66 which receives the threaded neck 68 of a pressure container such as the bottle 32 previously described. This assembly is sealed by O-ring 70 within a peripheral groove 72 about aperture 66.

Block 62 has an oblique face 74 which bears an internally threaded bore 76 that extends into but not through block 62. The bore 76 is counterbored at 78 and 80 at progressively decreasing diameters and a communicating passageway 82 is bored to extend from bore 66.

A valve insert member 84 is threadably received in bore 76 with its threaded shank 86 engaged by the threaded bore 76. The inboard end of shank 86 has a reduced diameter portion 88 which is received within counterbore 78. A resilient sealing gasket 90 is captured within this counterbore 78. The forward end of the insert member 86 is bored with a longitudinal passageway 92 and counterbored at 94 with a smaller diameter passageway, thereby forming a hard metal shoulder or seat 96. A ball 98 is placed in the bore 92 and is resiliently biased against the hard metal seat 96 by a helical coil spring 100 which is coaxially mounted within bore 92.

The opposite end of the insert number 84 has a larger diameter bore 102 which bears internal threads 104 and which communicates with the small diameter bore 94. The inboard end of this bore is milled at 106 to provide an annular seat 108 about the small diameter bore 94.

A metal pin 110 is slidably received within bore 94 and serve as a lift pin for ball 98. This pin is biased against the inboard end of the valve member piston 112 which has a central plug 114 of a soft plastic material such as polyurethane and the like for sealably engaging against the annular seat 108. Piston 112 has a peripheral groove which receives a sealing or packing means 116.

The valve closure member 115 is resiliently biased into a sealing position against the annular seat 108 by a resilient means in the form of a helical coil compression spring 118 which is captured between the inboard face of piston 112 and spring retainer 120 which is threadably received by threaded bore 104. The rod 122 of the piston actuator is bored at 124 for attachment of a lanyard and the like.

The inboard end of the insert member 84 bears a small diameter orifice passageway 126 which discharges into a chamber 128 in the valve housing block 62. This chamber 128 communicates with the discharge from the valve housing, conduit 33 shown in FIG. 1.

The valve structure as thus described comprises a start valve having a reseatable, resiliently biased valve closure member defined by piston 112 having a soft and sealing seat member 114 that engages the annular seat 108. The valve structure also has a pressure control means which comprises the ball 98 that engages against the hard metal seat 96. This ball member is biased closed by the internal pressure of the cylinder and the resilient spring 100. A sealing seat is not achieved because of the hard metal seat 96. As the supply pressure of the gas decreases, the ball member is lifted from seat 96 by pin 110 that is resiliently biased through valve member 115 and the resilient coil spring 118. This valve member thereby serves as a pressure regulator to maintain a substantially constant pressure within the chamber 130. The valve member also has a flow control means in the form of a fixed diameter orifice passageway 126 which communicates from chamber 130 to the outer chamber 128 which is an open communication through conduit 33 and flexible hose 36 to the hood of the invention. The gas supply valve 34 thus functions as a constant flow regulator to provide a predetermined and substantially constant gas flow into the hood during use of the device.

Figure 5:
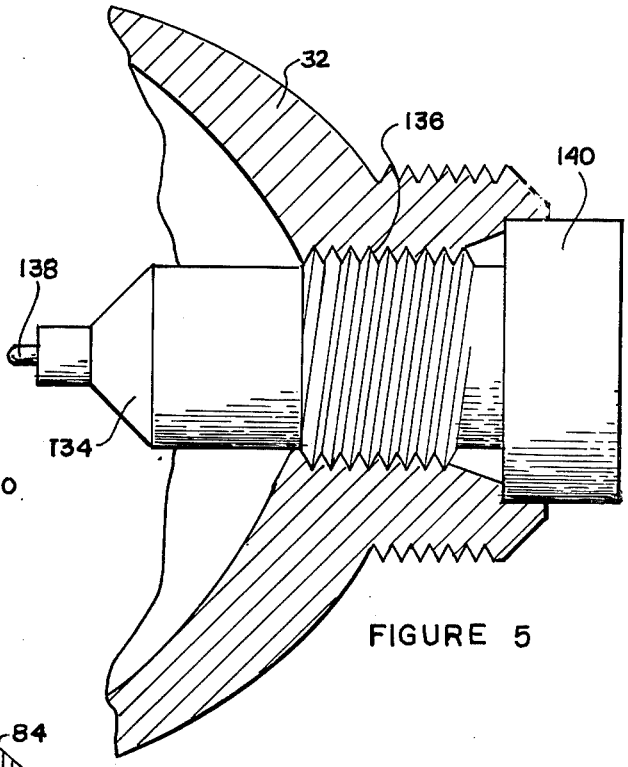
FIG. 5 is a view of a suitable pressure indicator useful in the invention.

The gas supply cylinder 32 can be provided with a suitable pressure indicator means. FIG. 5 illustrates the use of a suitable pressure indicator 134 which is threadably received in the internally threaded neck 136 at the opposite end of cylinder 32 from that received in the valve block 62. This pressure indicator is a conventional design and and comprises a pressure responsive helix Bourdon tube 138 that extends to a dial gauge 140 to reflect the internal pressure of cylinder 32.

Figure 6:
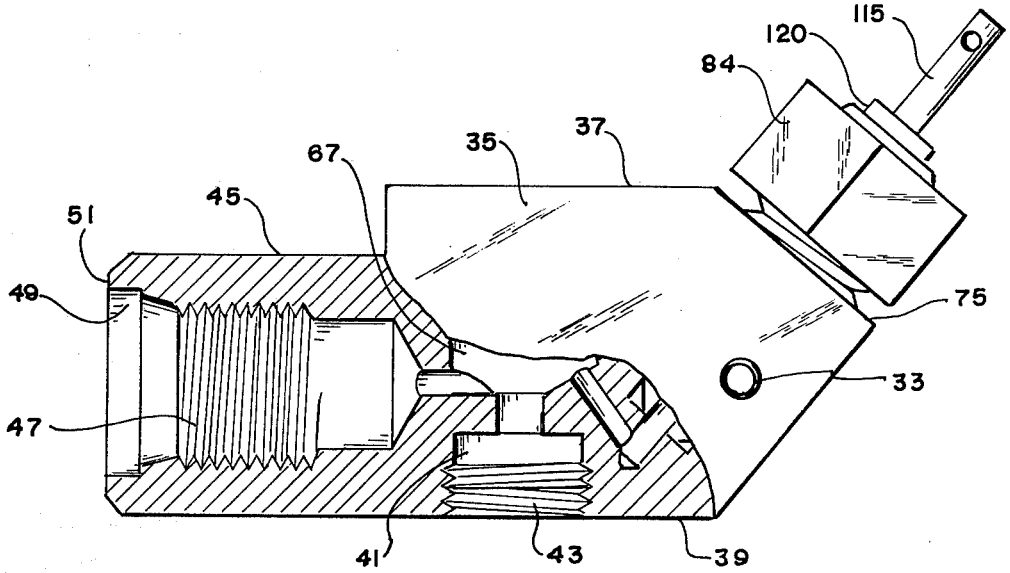
FIG. 6 is a view of an alternative embodiment of the gas flow control valve used in the invention.

Referring now to FIG. 6, another emodiment of the gas supply valve is illustrated. As there illustrated, the gas supply valve is contained within a machined block 35 which has a first face 37 that bears an internally threaded bore 67 which, as bore 66 described in FIG. 4, receives the neck of a pressured gas bottle such as 32. This block 35 also has an oblique face 75 which is machined similarly to that described in FIG. 4 to receive the valve insert member 84 which secures the same valve elements as described with regard to FIG. 4, including the rod 115 of the valve member and the spring retainer 120, all previously described.

The valve structure of FIG. 6 differs from that of FIG. 4 in that the face 39 has an internally threaded bore 41 which receives a flangible disc or rupture element 43. This element is of conventional, burst disc type construction and is adapted to rupture at the maximum safe operating pressure of the device, e.g., at about 6500–8000 psi.

The valve block 35 of the FIG. 6 embodiment also has an off-set portion 45 which has an internally threaded bore 47. A peripheral groove 49 is formed in the face 51 of this member. This threaded bore 47 is similar to the threaded neck 136 of the gas supply container 32 so that it can receive the pressure indicator assembly 134 with the dial indicator 140 described and illustrated in FIG. 5. In this manner, the block 35 contains all the functioning elements of the gas supply container, i.e., the gas supply valve mechanism, a rupture of burst disc member to protect over against over-inflation, and an available pressure indicator.

The entire device can be designed to provide a constant flow of a breathable atmosphere over a predetermined time period, from about 3 to about 7 minutes, preferably about 5 minutes. The gas supply source can comprise a nine cubic inch capacity steel container adapted for about 5000 psig internal pressure and this will supply adequate air to maintain a breathable atmosphere for a wearer under normal or extended exertion for a 5 minute period. Alternatively, a lower pressure rated aluminum or spun filament plastic container can be used. To illustrate, a container with a working pressure of 1800 psig can be used having a volume of about 20 cubic inches to provide a supply of breathable oxygen for the same predetermined time.

The device functions by maintaining a breathable atmosphere about the wearer's head. A sufficient supply of air is available from the container to permit the wearer, when re-breathing the air contained within the hood, to maintain a level of at least about 16–17% oxygen within the hood over a period of five minutes. As the air is introduced into the hood, the exhalation valve (elastomer film 22) provides a constant exhausting of the air from the hood thereby maintaining a constant, slightly super-atmospheric pressure within the hood 10. Typically, this hood is maintained at a pressure of from 0.018 to about 0.036 psi above the surrounding atmosphere. The gas supply valve is designed to provide a flow rate of about 10 liters per minute which is sufficient to equal the consumption of oxygen at a moderate exertion level such as climbing stairs, about 1.6 liters per minute.

The gas supply container has a suitable source of a breathable atmosphere. For safety purposes, this can comprise air or oxygen-enriched air having an elemental oxygen content less than about 28%, thereby avoiding any levels of oxygen which could readily ignite combustile materials. Alternatively, in some applications, it may be desirable to extend the usable period of the device by providing a breathable atmosphere containing higher elemental oxygen contents. Thus the invention contemplates the use of a pure oxygen or oxygen contents within the container 32 at any level from 20.9 to 100%.

The invention has been described with reference to the illustrated and presently preferred embodiments. It is not intended that the invention be unduly limited by this disclosure of the presently preferred embodiment. Instead, it is intended that the invention be defined by the means, and their obvious equivalents, set forth in the following claims.

What is claimed is:

1. A protective hood for a person's head to receive a breathable atmosphere containing elemental oxygen from a source thereof and to maintain said atmosphere for said person in a hostile environment which comprises:

a. a sealed tent in the shape of a tetrahedron having a front and two side vertical walls formed of a thin transparent plastic film;

b. a thin elastomer film sealed at its outer edges to the bottom edges of said vertical walls and having a central opening of sufficient diameter in a stretched state to receive said person's head and to yieldably seal when released about the person's neck whereby said elastomer film functions as an exhalation valve means to maintain an internal pressure within said hood at sufficient value to maintain said hood inflated but insufficient to prevent normal breathing of said person; and said hood having a single aperture in said front vertical wall for connection to said breathable atmosphere source whereby fresh gas supply is directed at the person's face.

2. The protective hood of claim 1 wherein said elastomer comprises a latex of natural or synthetic rubber as a film having a thickness from 2 to about 10 mils.

3. The protective hood of claim 2 wherein said latex film has a thickness from 3 to about 5 mils.

4. The protective hood of claim 1 wherein said hood is in the shape of an irregular tetrahedron.

5. The protective hood of claim 1 in combination with a breathable atmosphere source comprising a pressured container of an elemental oxygen containing gas attached by strap means to said elastomer film and a flexible hose communicating from said source to said hood to deliver gas thereto through said single aperture.

6. The hood and atmosphere source combination of claim 6 wherein said strap means are passed about said central opening and the neck of said person to support said container.

7. The hood and atmosphere source combination of claim 6 further including gas supply valve means connected to said container to discharge gas therefrom to said hose and comprising:

a. a valve body, a cavity therein, a flow passageway communicating between said container and valve body cavity, a start-stop valve closure member resiliently biased to close said passageway from said valve cavity;

b. pressure controls means in said passageway upstream of said valve closure member; and c. flow controls means downstream of said valve cavity and communicating between said cavity and said hose.

8. The hood and atmosphere source of claim 7 wherein said flow control means comprises a fixed diameter orifice downstream of said pressure control means.

9. The hood and atmosphere source combination of claim 7 wherein said gas supply valve means includes valve seat means about the discharge of said passageway into said cavity, and a piston slidably received and sealed within said cavity, and wherein said valve closure member is carried on the face of said piston opposite said valve seat and movable between open and closed registration therewith and resilient means is mounted in said cavity to bias said piston and valve closure means into closed registration with said valve seat means.

10. The hood and atmosphere source combination of claim 9 wherein said pressure control means comprises:

a. hard seat means in said passageway;

b. ball means confined in said passageway upstream of said hard seat means;

c. second resilient means biasing said ball against said hard seat means and;

d. pin means slidably received in said passageway and extending therethrough to bear against said piston.

11. The hood and atmosphere source combination of claim 10 wherein said valve closure member is in bearing contact with said pin means.

12. The hood and atmosphere source combination of claim 11 wherein said valve closure member comprises a soft face element to engage said valve seat means.

13. The hood and atmosphere source combination of claim 12 wherein said soft face element comprises a plastic plug received in the face of said piston.

14. The hood and source combination of claim 11 wherein a helical coil spring comprises said resilient means.

15. A breathing assembly of a breathing means for delivery of a breathable atmosphere to a person in combination with breathable gas supply means comprising a closed, pressured container of breathable gas and gas supply valve means having a valve body received on said container and an outlet port discharging to said breathing means, said valve body internally bearing:

(a) a valve cavity, an inlet passageway discharging into said cavity, a piston slidably received and sealed within said cavity, valve closure means carried on said piston, cooperative valve seat means about the discharge of said passageway into said cavity, and resilient means biasing said piston to seat said valve closure means against said valve seat means, and a valve outlet communicating with said cavity;

(b) pressure control means comprising hard metal seat means in said inlet passageway and a cooperative hard metal ball means with resilient means biasing said ball against said hard metal seat means;

(c) a pin received in said passageway and extending between said valve closure means and said ball;

(d) orifice means between said valve closure member and the outlet of said valve means; and (e) a rod secured to said piston and projecting exteriorly of said valve body and providing hand grasp means whereby the person can manually retract said piston and open said gas supply valve means.

16. The breathing assembly of claim 15 wherein said valve body has a first internally threaded bore communicating with said inlet passageway to receive the threaded neck of an air supply bottle.

17. The breathing assembly of claim 16 wherein said valve body has a second internally threaded bore, an externally threaded cylinder enclosing said piston, said piston bearing said valve closure member being slidably received in said cylinder which is threadably received in the second internally threaded bore of said valve body.

18. The breathing assembly of claim 15 wherein said breathing means comprises a hood with a bottom wall formed of thin film elastomeric membrane having a central opening of a sufficient diameter in a stretched state to receive a person's head and to yieldably seal when released about a person's neck.

19. The breathing assembly of claim 18 wherein said hood has a single aperture in communication with the outlet of said valve means whereby said elastomeric membrane functions as an exhalation valve to maintain an internal pressure within said hood at a sufficient valve to maintain said hood inflated but insufficient to prevent normal breathing of a person.

* * * * *

UNITED STATES PATENT AND TRADEMARK OFFICE

CERTIFICATE OF CORRECTION

PATENT NO. : 4,221,216

DATED : September 9, 1980

INVENTOR(S) : Max L. Kranz

It is certified that error appears in the above-identified patent and that said Letters Patent are hereby corrected as shown below:

Column 6, claim 8, lines 3 and 4, delete "downstream of said pressure control means"

Signed and Sealed this

*Sixth* Day of *January 1981*

[SEAL]

*Attest:*

SIDNEY A. DIAMOND

*Attesting Officer*

*Commissioner of Patents and Trademarks*